US010006629B2

(12) United States Patent
Acocella et al.

(10) Patent No.: US 10,006,629 B2
(45) Date of Patent: Jun. 26, 2018

(54) BURNER

(71) Applicant: WORGAS BRUCIATORI S.R.L., Formigine (IT)

(72) Inventors: Antonio Acocella, Formigine (IT); Jimmy Nassiboo, Formigine (IT); Gabriele Gangale, Formigine (IT); Tullio Paltrinieri, Formigine (IT)

(73) Assignee: WORGAS BRUCIATORI S.R.L., Formigine (IT)

( * ) Notice: Subject to any disclaimer, the term of this patent is extended or adjusted under 35 U.S.C. 154(b) by 451 days.

(21) Appl. No.: 14/876,240

(22) Filed: Oct. 6, 2015

(65) Prior Publication Data

US 2016/0102858 A1 Apr. 14, 2016

(30) Foreign Application Priority Data

Oct. 10, 2014 (IT) ..... MI2014A1775

(51) Int. Cl.

| | |
|---|---|
| ***F23D 14/58*** | (2006.01) |
| ***F23D 14/62*** | (2006.01) |
| ***F23D 14/70*** | (2006.01) |
| ***F23D 14/02*** | (2006.01) |

(52) U.S. Cl.

CPC ..... *F23D 14/58* (2013.01); *F23D 14/02* (2013.01); *F23D 14/62* (2013.01); *F23D 14/70* (2013.01); *F23D 2203/102* (2013.01); *F23D 2203/1012* (2013.01); *F23D 2210/00* (2013.01); *F23D 2900/00003* (2013.01); *F23D 2900/14021* (2013.01)

(58) Field of Classification Search

CPC ..... F23D 2203/1012; F23D 2203/102

See application file for complete search history.

(56) References Cited

U.S. PATENT DOCUMENTS 5,813,850 A 9/1998 Kyoung-Sik

FOREIGN PATENT DOCUMENTS

| | | |
|---|---|---|
| CH | 687938 A5 | 3/1997 |
| EP | 2037175 A2 | 3/2009 |
| WO | 2009112909 A2 | 9/2009 |

OTHER PUBLICATIONS

Italian Search Report dated May 28, 2015.

*Primary Examiner* — Kenneth Rinehart
*Assistant Examiner* — Logan Jones
(74) *Attorney, Agent, or Firm* — Arent Fox LLP; Michael Fainberg

(57) ABSTRACT

A burner comprises a tubular diffuser wall and an inlet passage for a gas mixture into the diffuser wall, as well as a first diaphragm with one or more first through openings and a second diaphragm with one or more second through openings of different shape and distribution from those of the first through openings, said first and second diaphragms being substantially concentric and arranged in sequence in the inlet passage.

13 Claims, 6 Drawing Sheets

BURNER

BACKGROUND

The present invention relates to a gas burner for boilers and for industrial applications, of the type comprising:

a support wall which can be connected to a combustion chamber of the boiler or industrial application, the support wall having an inlet passage for introducing a mixture of fuel gas and oxidant into the burner, a tubular diffuser wall having a first end connected to the support wall in flow communication with the inlet passage, a second end closed by a closing bottom, and a perforation for the passage of the gas mixture from the interior of the burner to an outer side of the diffuser wall, where the combustion occurs, a tubular element positioned inside the diffuser wall and having a base connected to the support wall in flow connection with the inlet passage and a free end forming an outlet opening in an intermediate position between the first end and the second end of the diffuser wall.

This known burner was described in Patent Application WO2009/112909 by the Applicant and aims to overcome the problems of noisiness of previously known cylindrical burners. Due to the tubular element inside the burner, the resonance frequencies of the burner may be modified, and the vibration frequencies caused by the resonance frequencies of the burner during operation may be removed, thus reducing the noisiness thereof and the cyclical mechanical stresses due to the vibrations themselves.

However, burners provided with the "anti-noise" tubular element show a non-uniform flame distribution over the outer surface of the diffuser, thus preventing the burner dimensions from being optimally utilized for the purposes of heat generation.

Finally, the local overheating of the diffuser wall, which is due to the presence of the "anti-noise" tubular element, results in a high "flash back" risk of the ignition of the oxidant-fuel mixture still upstream of the diffuser wall.

Therefore, it is the object of the present invention to provide a gas burner of the type described above, but modified so as to overcome the drawbacks of the known art.

SUMMARY

Within the scope of the general object, it is one particular object of the invention:—to improve the known burner so as to maintain a reduced noisiness, and in particular to eliminate the occurrence of whistles ascribable to vibrations in the coupling of the gas valve to the burner, and simultaneously, to improve the uniformity and stability of flame and combustion, and to reduce a risk of local overheating of the diffuser wall These and other objects are achieved by a burner, comprising:

a support wall which can be connected to a combustion chamber of the boiler or industrial application, said support wall forming an inlet passage for introducing a mixture of fuel gas and oxidant into the burner, a tubular diffuser wall, which is coaxial to a longitudinal axis of the burner and has a first end connected to the support wall in flow communication with the inlet passage, a second end closed by a closing bottom, and a perforation for the passage of the gas mixture from the interior of the burner to an outer side of the diffuser wall, where the combustion occurs, a first diaphragm with one or more first through openings and a second diaphragm with one or more second through openings, said first and second diaphragms being substantially concentric with the longitudinal axis and arranged in sequence in the inlet passage, so that when the mixture of fuel gas and oxidant is introduced into the burner, said mixture passes first through the one or more first openings of the first diaphragm and then through the one or more second openings of the second diaphragm, wherein the first and second diaphragms each form a radially inner circular portion and an adjacent (directly neighboring) radially outer annular portion, respectively, wherein:

the radially outermost extent of said one or more first openings defines (i.e. is equal to) an outer radius Re of the outer portions, the ratio Ri/Re of the radial width Ri of the inner portion to the outer radius Re of the outer portion is from 0.6 to 0.7, preferably about 0.65, in the radially outer annular portions, the passage area of said one or more first openings is larger than the passage area of said one or more second openings, in the radially inner portions, the passage area of said one or more second openings is larger than the passage area of said one or more first openings, the free axial distance between the first diaphragm and the second diaphragm is from 4 mm to 50 mm, preferably from 6 mm to 12 mm, advantageously about 8.5 mm, or expressed as a function of the outer radius Re, the free axial distance between the first diaphragm and the second diaphragm is from 0.22*Re to 0.43*Re, preferably about 0.31*Re.

By virtue of the predominant presence of the first openings of the first diaphragm in the radially outer zone and of the predominant presence of the second openings of the second diaphragm in the radially inner zone of the diaphragms, the flow of gas mixture is subjected to a radially inwards deflection when introduced into the burner, which deflection tends to define an axial concentric flow along the longitudinal axis of the burner. Close to the closing bottom, the flow thus "compacted" is sent back and "broadened" radially outwards to extend axially along the inner surface of the diffuser wall in a uniform manner, Although it is difficult to identify all the mechanisms which contribute to the technical effects obtained, the tests performed have shown a causal connection between the presence of the two diaphragms configured according to the invention and a lower noisiness, in particular with reference to the aforesaid whistles, as well as an improved flame stability and uniformity, and a lower tendency for local overheating of the diffuser wall,

BRIEF DESCRIPTION OF THE DRAWINGS

In order to better understand the invention and appreciate the advantages thereof, some non-limiting embodiments will be described below, with reference to the figures, in which.

DETAILED DESCRIPTION

Figure 1:
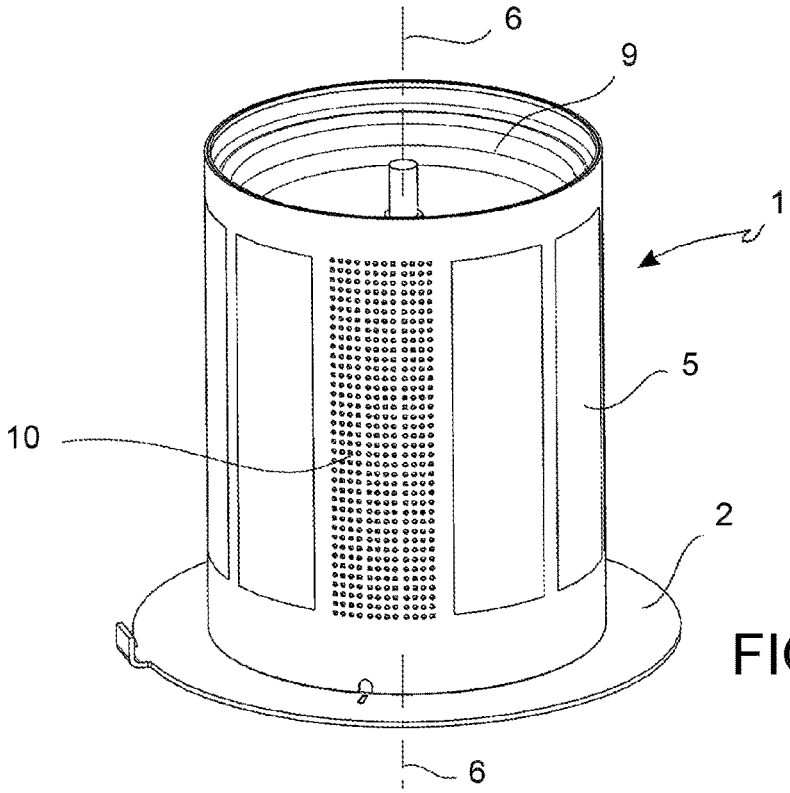
FIG. 1 is a perspective view of a burner according to one embodiment.
Figure 2:
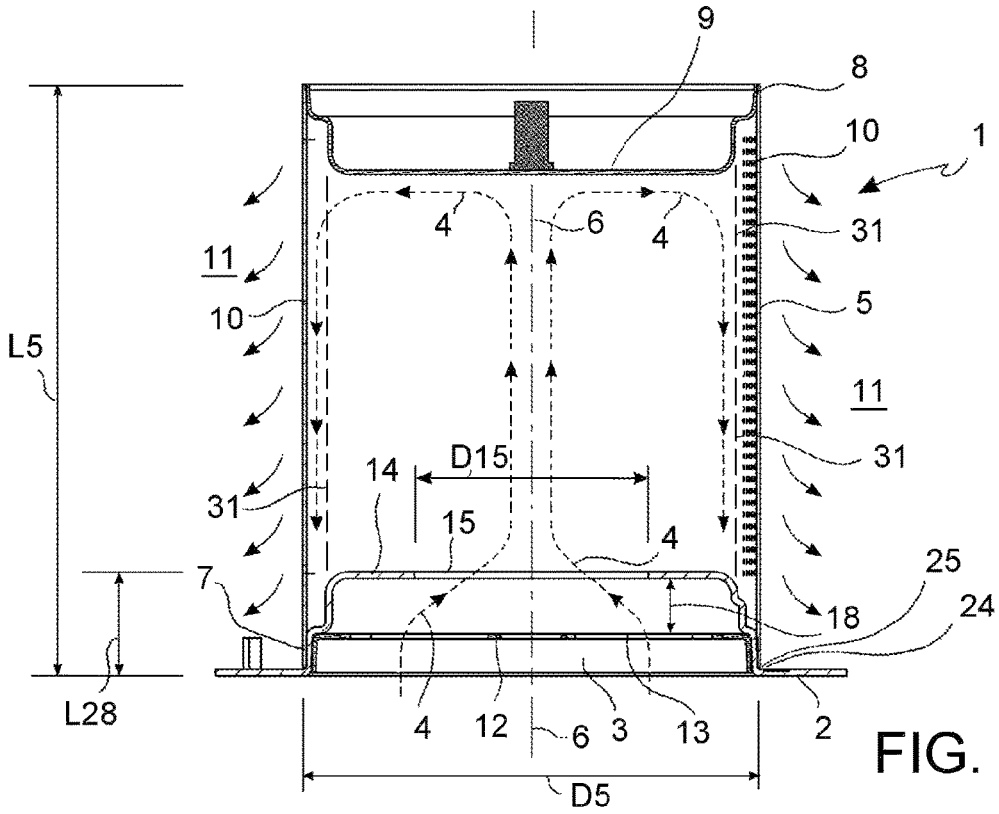
FIG. 2 is a longitudinal section view of the burner in FIG. 1, on a sectional plane which is radial to the longitudinal axis of the diffuser.
Figure 3:
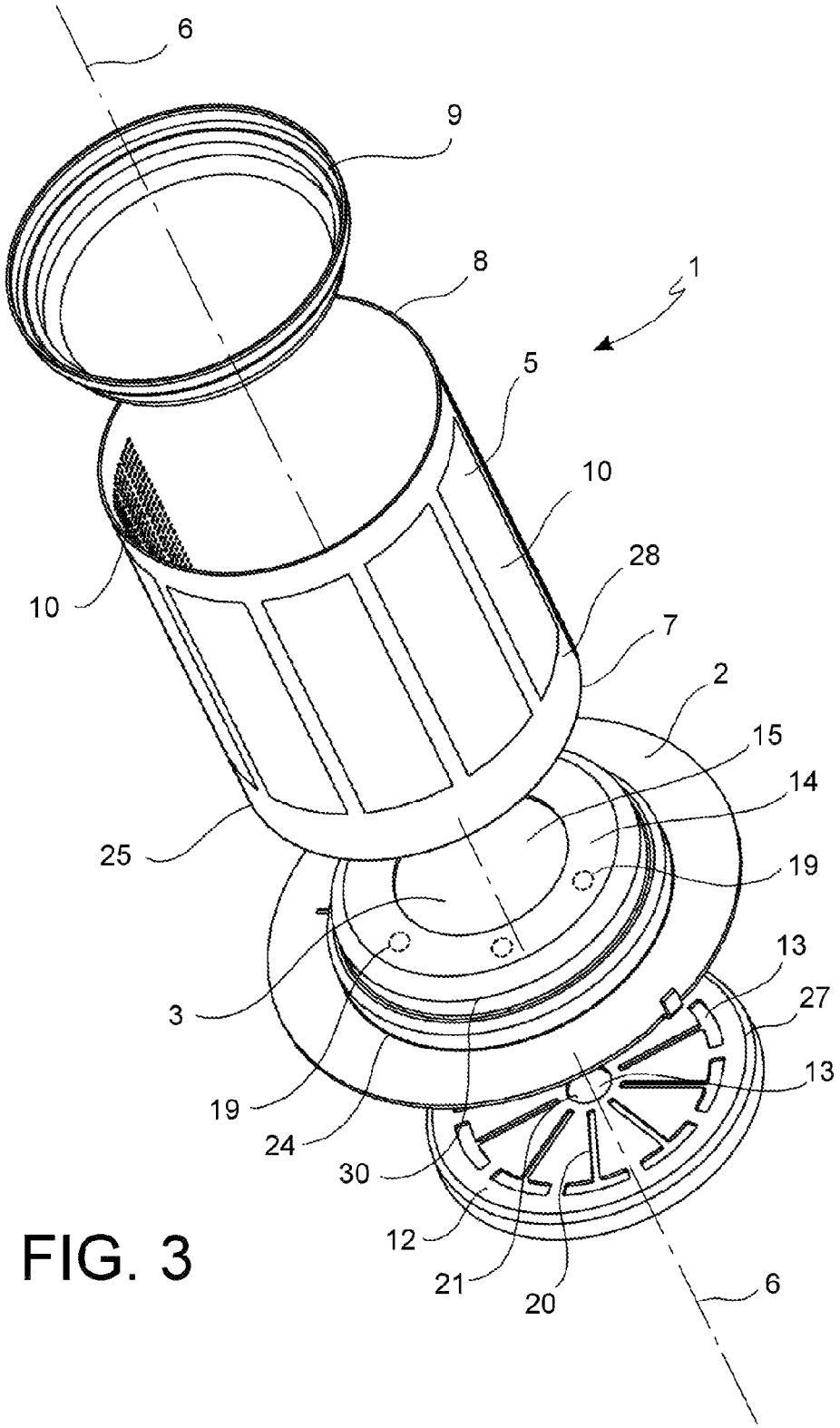
FIG. 3 is an exploded perspective view of the burner in FIG. 1.
Figure 4:
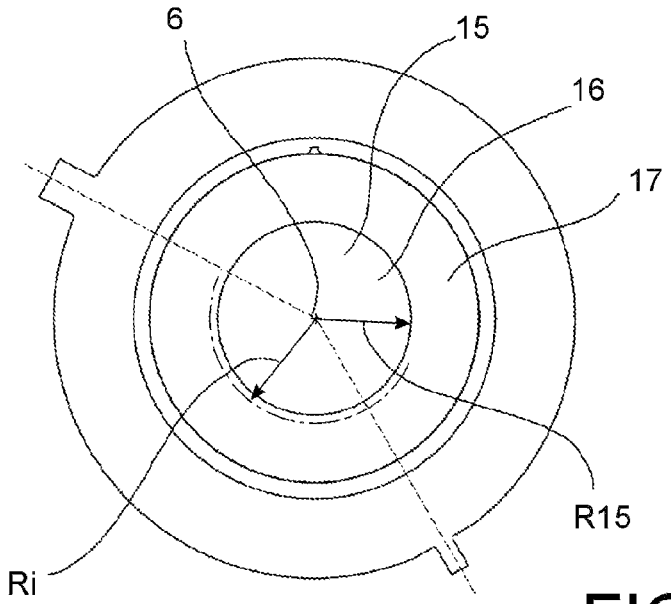
FIGS. 4, 5 and 6 are top, radial section, and side views of a support wall with a diaphragm of a burner according to one embodiment.
Figure 5:
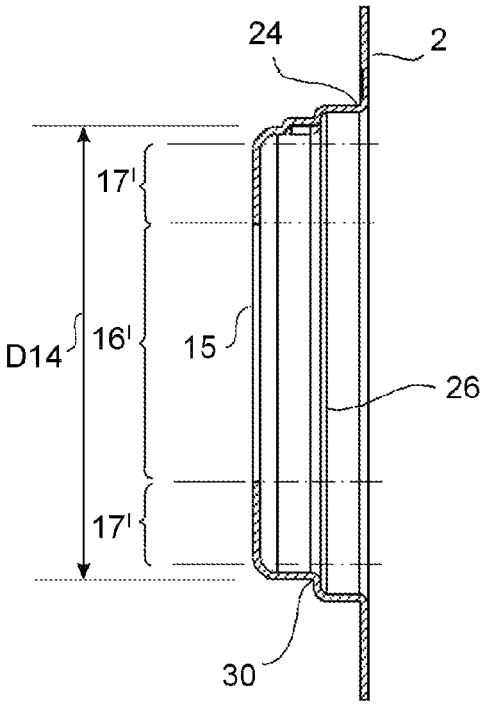
Figure 6:
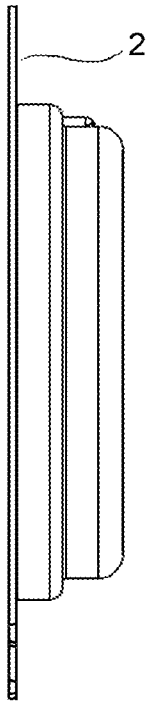

With reference to the figures, a gas burner for boilers or industrial applications which generates heat by means of the combustion of a fuel gas in general or of a premixture of fuel gas and air in particular, is indicated as a whole by numeral 1. Burner 1 comprises a support wall 2 which can be connected to a combustion chamber of the boiler or industrial application, the support wall 2 forming an inlet passage 3 for introducing a mixture 4 of fuel gas and oxidant into burner 1.

Burner 1 further comprises a diffuser wall 5, which is tubular and coaxial with respect to a longitudinal axis 6 of burner 1 and has a first end 7 connected to the support wall 2 in flow communication with the inlet passage 3, a second end 8 closed by a closing bottom 9, and a perforation 10 for the passage of the gas mixture 4 from the interior of burner 1 to an outer side 11 of the diffuser wall 5, where the combustion occurs.

According to one aspect of the invention, burner 1 comprises a first diaphragm 12 with one or more first through openings 13 and a second diaphragm 14 with one or more second through openings 15, said first 12 and second 14 diaphragms being substantially concentric with the longitudinal axis 6 and arranged in sequence in the inlet passage 3, so that when the mixture 4 of fuel gas and oxidant is introduced into burner 1, said mixture 4 passes first through the one or more first openings 13 of the first diaphragm 12 and then through the one or more second openings 15 of the second diaphragm 14.

The first and second diaphragms 12, 14 each form a radially inner circular portion 16, 16' and a radially outer, adjacent (directly neighboring) annular portion 17, 17', respectively, in which:

the radially outermost extent of said one or more first openings 13 defines an outer radius Re of the outer portions 17, The ratio Ri/Re of the radial width Ri of the inner portion 16, 16' to the outer radius Re of the outer portion 17, 17' is from 0.6 to 0.7, preferably about 0.65, in the outer portions 17, 17', the passage area of said one or more first openings 13 is larger than the passage area of said one or more second openings 15, in the inner portions 16, 16', the passage area of said one or more second openings 15 is larger than the passage area of said one or more first openings 13, the free axial distance 18 between the first diaphragm 12 and the second diaphragm 14 is from 4 mm to 50 mm, preferably from 6 mm to 12 mm, advantageously about 8.5 mm, or expressed as a function of the outer radius Re, the free axial distance 18 between the first diaphragm 12 and the second diaphragm 14 is from 0.22*Re to 0.43*Re, preferably about 0.31*Re.

By virtue of the predominant presence of the first openings 13 of the first diaphragm 12 in the radially outer zone 17 and of the predominant presence of the second openings 15 of the second diaphragm 14 in the radially inner zone 16', the flow of mixture 4 is subjected to a radially inwards deflection when introduced into burner 1. This tends to determine an axial concentric flow compacted along the longitudinal axis 6 of the burner. Close to the closing bottom 9, the flow thus "compacted" broadens radially outwards in a uniform manner and is sent back to extend axially along the inner surface of the diffuser wall 5 in a uniform manner.

Within the scope of the present description, the terms "radially inner portion" and "radially outer portion" refer to a geometrical division applied to both the first 12 and second 14 diaphragms, and their dimensions intended as position and radial extent with respect to the longitudinal axis 6 are identical for both the first 12 and second 14 diaphragms.

Experimental tests have shown a causal connection between the presence of the two diaphragms configured according to the invention and a lower noisiness, in particular with reference to the so-called whistles, as well as improved flame stability and uniformity, and a lower tendency for local overheating of the diffuser wall. Furthermore, the invention allows the elimination of the "anti-noise" tubular element and therefore a structural simplification and a reduction of the costs for manufacturing burner 1.

According to one embodiment, the first diaphragm 12 and the second diaphragm 14 are made of metal sheet, preferably of steel.

The first diaphragm 12 and the second diaphragm 14 are preferably substantially planar and substantially parallel to each other and orthogonal to the longitudinal axis 6.

Alternatively, the first diaphragm 12 and/or the second diaphragm 14 can have a rounded shape, e.g. a flattened dome, or they can have circumferential and/or radial steps with respect to the longitudinal axis 6. However, the first 12 and second 14 diaphragms preferably have a substantially symmetrical shape with respect to the longitudinal axis 6. This does not exclude, in certain embodiments, the pattern of the first through openings 13 and/or the pattern of the second through openings 15 from not being perfectly symmetrical with respect to the longitudinal axis 6.

However, in a preferred embodiment, although the patterns of the first and second through openings 13, 15 are not mutually equal, they are symmetrical with respect to the longitudinal axis 6.

In one embodiment (FIGS. 3, 4-6), the second through openings 15 of the second diaphragm 14 consist of a single central opening 15, which is preferably circular and concentric with the longitudinal axis 6. The central opening 15 of the second diaphragm 14 has, with respect to the longitudinal axis 6, a radial extent R15 equal to 0.5*Re . . . 0.8*Re, preferably 0.6*Re . . . 0.7*Re, even more preferably to about 0.65*Re, where Re is the outer radius of the outer portion 17, 17' of the first 12 and second 14 diaphragms.

In an alternative embodiment, the second through openings 15 of the second diaphragm 14 consist of a central opening 15, preferably circular and concentric with the longitudinal axis 6, and of a plurality of peripheral holes 19 formed in the radially outer portion 17' of the second diaphragm 14 and having a total passage area which is smaller than the passage area of the central opening 15.

In one embodiment of the first diaphragm 12 (which can be combined with any one of the conformations of the second diaphragm 14 described hereto), the first through openings 13 comprise a group of peripheral openings 20, obtained in the radially outer portion 17 of the first diaphragm 12 and having a total passage area (sum of the passage areas of the entire group of peripheral openings 20) which is larger than the total passage area of any further first through openings 21 obtained in the radially inner portion 16 of the first diaphragm 12. The group of peripheral openings 20 is advantageously arranged in one or more circumferential sequences with respect to the longitudinal axis 6.

Advantageously, the first through openings 13 further comprise a central hole 21 concentric with the longitudinal axis 6 and having a passage area which is smaller than both the total passage area of the first through openings 13 in the radially outer portion 17 of the first diaphragm 12, and the total passage area of the second through openings 15 in the radially inner portion 16' of the second diaphragm 14. The central hole 21 of the first diaphragm 12 has, with respect to the longitudinal axis 6, a radial extent R21 equal to 0.1*Re . . . 0.25*Re, preferably 0.12*Re . . . 0.22*Re, even more preferably of about 0.17*Re, where Re is the outer radius of the outer portion 17, 17' of the first 12 and second 14 diaphragms.

Indeed, experimental tests have shown a further surprising decrease in the noisiness of the burner when there is a central hole in the first diaphragm 12, having significantly small dimensions as compared to the dimensions of the first through openings 13 in the radially outer portion 17 of the first diaphragm 12, and as compared to the dimensions of the second through openings 15 in the radially inner portion 16' of the second diaphragm 14.

In a preferred embodiment (FIGS. 3, 7 9), the first through openings 13 comprise a group of peripheral openings 20 having a (preferably identical) "T" shape and arranged in a circumferential sequence with respect to the longitudinal axis 6 (and preferably at constant angular pitch). Each of the peripheral openings 20 forms a substantially rectilinear portion 22, oriented in the radial direction with respect to the longitudinal axis 6, and a rectilinear or curved tangent portion 23 substantially extending in the circumferential direction with respect to the longitudinal axis 6.

This embodiment of the first diaphragm 12, when combined with the central hole 21, is particularly advantageous with reference to flame stability and to a uniform distribution of the combustion on the outer surface of the diffuser wall 5.

Figure 7:
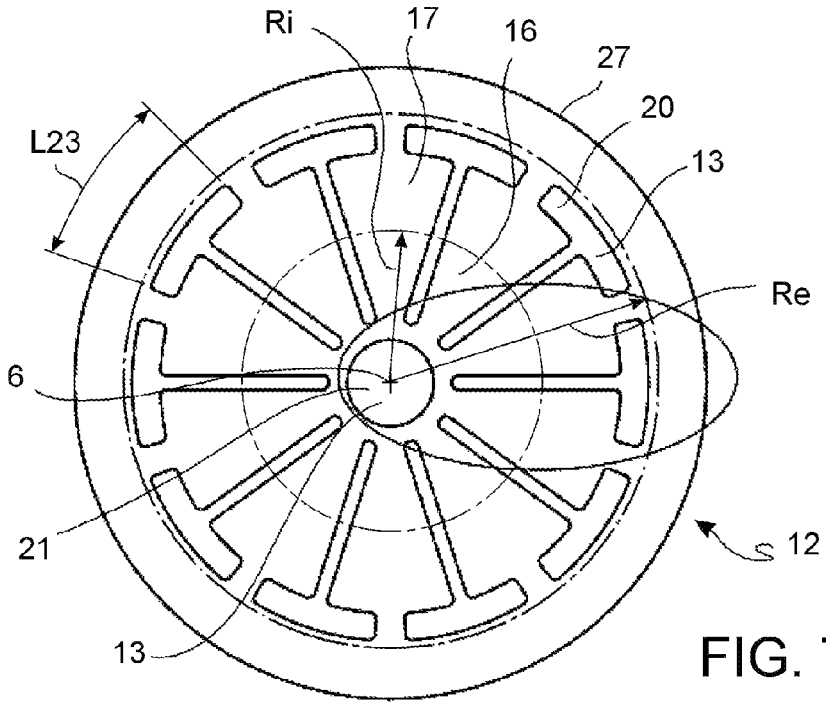
FIGS. 7 and 8 are top and radial section views of a further diaphragm of the burner according to one embodiment.
Figure 8:
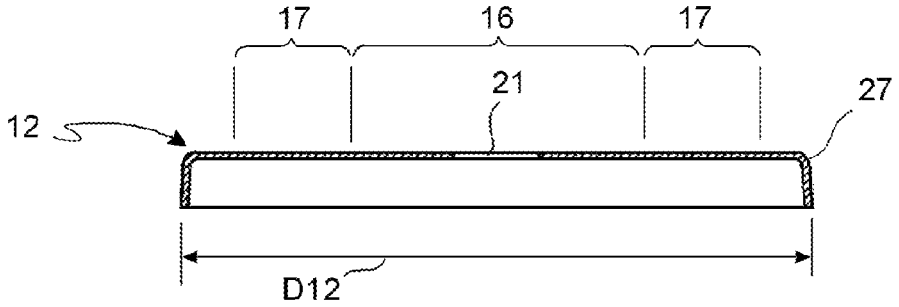
Figure 9:
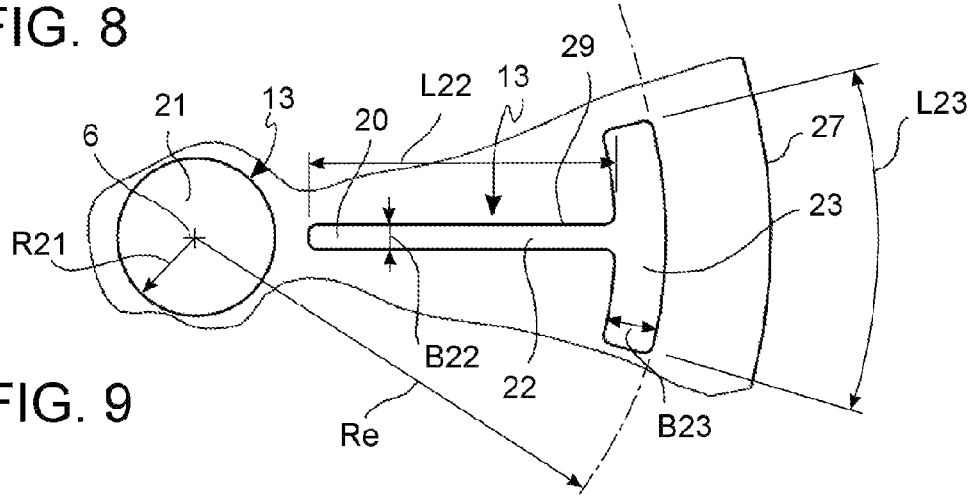
FIG. 9 shows a detail of the further diaphragm in FIGS. 7 and 8.
Figure 10:
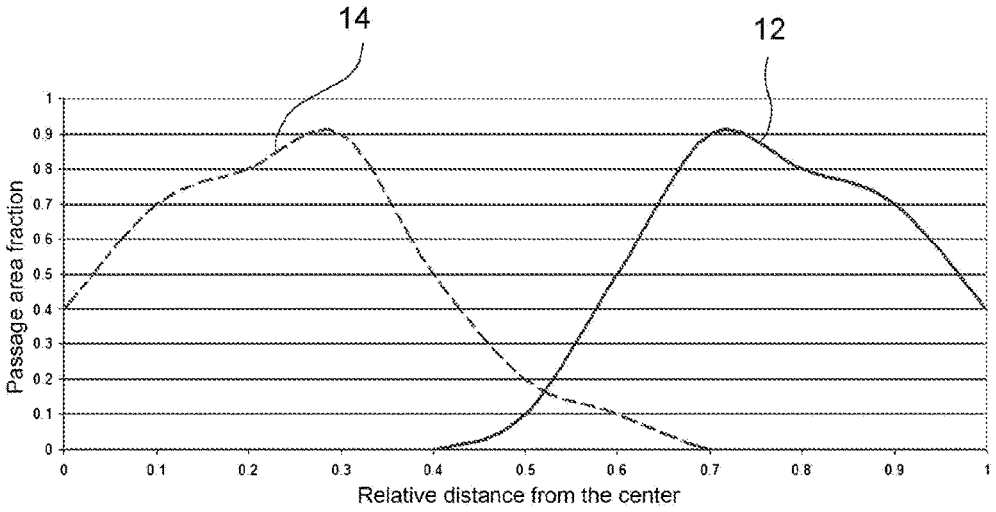
FIG. 10 is a diagrammatic representation of the trend of the ratio of the passage area to the total area of a first and second diaphragms depending on the radial distance from the longitudinal axis of a burner according to the invention.
Figure 11:
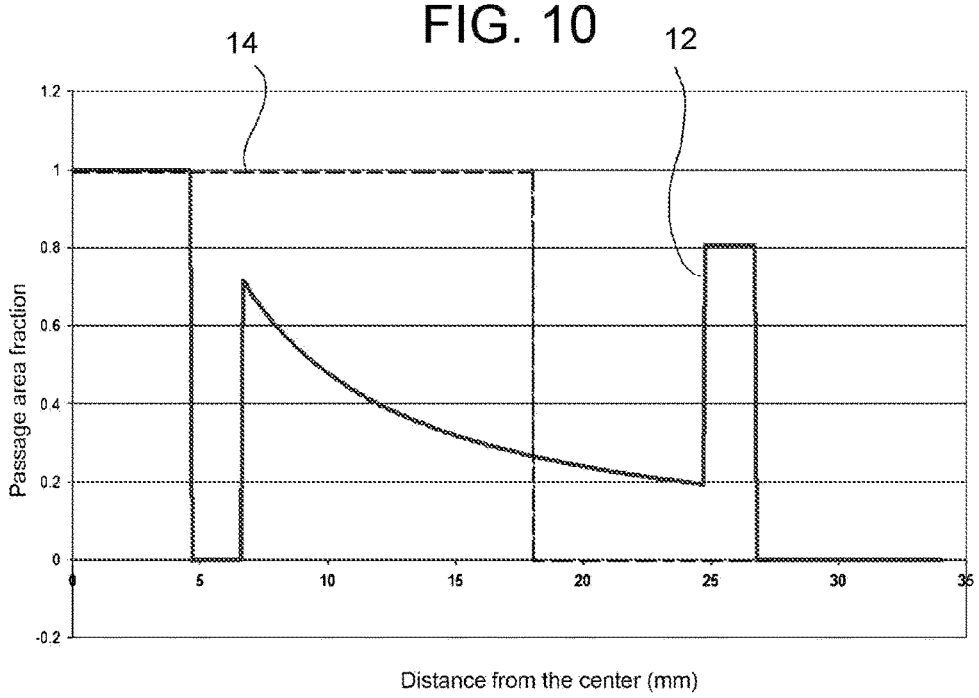
FIG. 11 is a diagrammatic representation of the trend of the ratio of the passage area to the total area of a first and second diaphragm depending on the radial distance from the longitudinal axis of the burner, according to the embodiment in FIG. 3.
Figure 12:
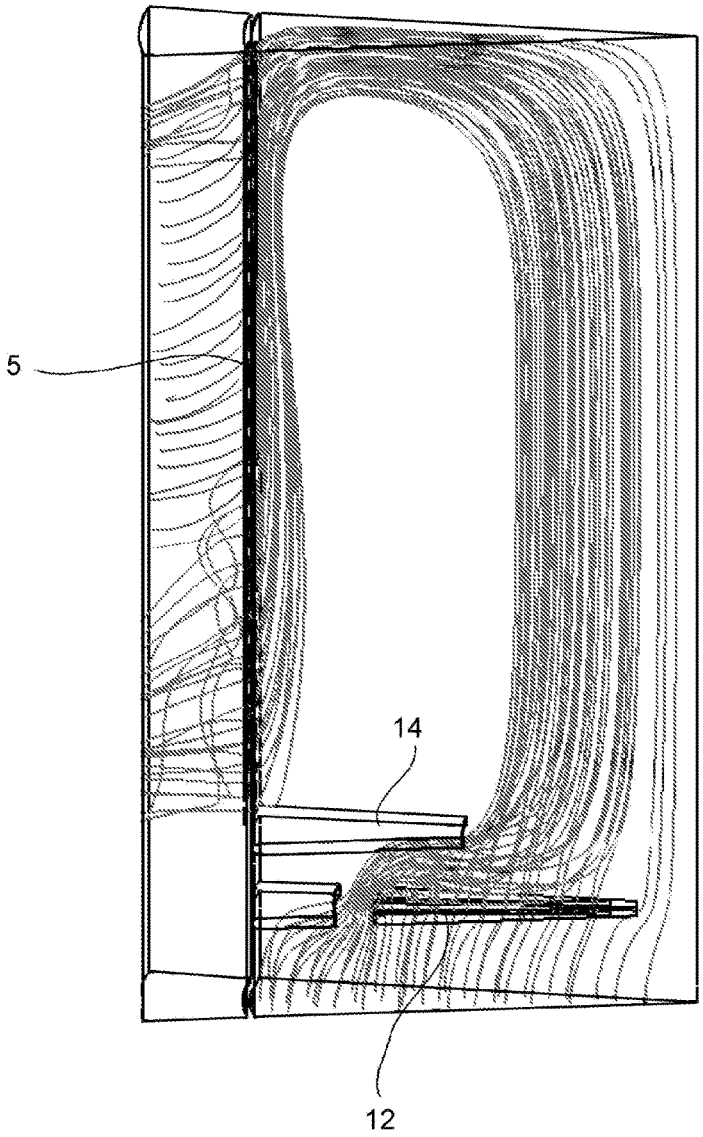
FIG. 12 is a diagrammatic representation of the flow conditions obtained by a burner according to the invention.

Advantageously, in the peripheral openings 20, the radial width B23 of the tangent portion 23 is larger than the circumferential width B22 of the rectilinear portion 22, In one embodiment, there are ten peripheral openings 20 and they are arranged at a constant angular pitch 36°, the angular extent L23 of the tangent portion 23 thereof is 25° . . . 32°, preferably about 29°, the radial width B23 of the tangent through portion 23 is 0.09*Re . . . 0.13*Re, preferably about 0.11*Re, a radially outer edge of the tangent portion 23 determines the outer radius Re of the radially outer portion 17, 17', and the radial length L22 of the rectilinear portion 22 is 0.6*Re . . . 0.7*Re, preferably about 0.65*Re (FIGS. 7, 9).

All the "radial extents" indicated with reference "R . . . " indicate a radial extent measured from the longitudinal axis 6 of burner 1. In the case of a circular hole which is concentric with the longitudinal axis 6, the diameter of the hole would be the same as the radial extent "R . . . " thereof multiplied by 2.

The first and second diaphragms 12, 14 can be Formed in a single piece with the support wall 2 or connected thereto, for example by means of welding or press-fitting.

In an advantageous embodiment, the support wall 2 is made of metal sheet, e.g. of steel, and forms:

an outer circumferential seat 24 (circumferential step) facing the outside of burner 1 and adapted to receive a front edge 25 of the diffuser wall 5, an inner circumferential seat 26 (circumferential step) facing the interior of burner 1 and adapted to receive an outer edge 27 of the first diaphragm 12 and to ensure a proper positioning thereof, the second diaphragm 14, optionally, a further outer circumferential seat 30 (circumferential step) facing the outside of burner 1 and adapted to receive a front edge of a distributor wall 31.

Both diaphragms 12, 14 are advantageously located inside, and do not extend beyond, an end length 28 of the diffuser wall 5 at the support wall 2, where said end length 28 has an axial length L28 less than one fourth of the axial length L5 of the diffuser wall 5, preferably less than one fifth of the axial length L5 of the diffuser wall 5.

In a further embodiment, the first diaphragm 12 comprises deflection edges 29 at least partially defining said first through openings 13, 20 and which are bent outside the plane of the first diaphragm 12 so as to impart a swirl in the circumferential direction with respect to the longitudinal axis 6 to the flow of mixture 4. This further contributes to concentrating the entering flow of mixture 4 along the longitudinal axis 6 of the burner.

In accordance with one embodiment, the diffuser wall 5 consists of a perforated steel sheet and is cylindrical or slightly truncated-conical in shape. Additionally or alternatively, the perforated steel sheet of the diffuser wall 5 may be covered on the outside with an outer layer of mesh or fabric (not shown) made of metal or ceramic or sintered material, which forms the outer surface of the diffuser wall 5 on which the combustion occurs, When provided, a distribution wall 31 may consist of a perforated steel sheet which is cylindrical or slightly frusto-conical in shape, which is coaxial with the longitudinal axis 6 and is positioned inside the diffuser wall 5.

In a non-limiting exemplary embodiment, the geometrical parameters of burner 1 may be as follows:

axial distance 18 between the first and second diaphragms 12, 14: 7 mm . . . 8.5 mm . . . 9 mm, diameter D12 of the first diaphragm 12: 63 mm . . . 68 mm . . . 73 mm, diameter D14 of the second diaphragm 14: 58 mm . . . 63 mm . . . 68 mm, outer radius Re: 23 mm . . . 28 mm . . . 33 mm, radial extent R15 of the central opening 15: 32 mm . . . 36 mm . . . 38 mm, radial extent R21 of the central hole 21: 3.5 mm . . . 4.6 mm . . . 5.5 mm, radial width 1323 of the tangent portion 23: 2.5 mm . . . 3 mm . . . 3.5 mm, angular extent L23 of the tangent portion 23: 25° . . . 29° . . . 32°, diameter D5 of the diffuser wall 5: 65 mm . . . 70 mm . . . 75 mm, axial length L5 of the diffuser wall 5: 85 mm . . . 90 mm . . . 95 mm, radial length L22 of the rectilinear portion 22: 15 mm . . . 18.2 mm . . . 19 mm.

Burner 1 according to the invention has several advantages, in particular the reduction of the noisiness, increased flame uniformity and stability, and a smaller risk of locally overheating the diffuser wall. By virtue of the flame uniformity and the homogeneous distribution of the combustion on the diffuser wall, the need to provide an additional distribution wall upstream of the diffuser wall 5 may be obviated.

In order to meet contingent and specific needs, those skilled in the art will be obviously able to make further changes and variants to the burner according to the present invention, all contained within the scope of protection of the invention, which is defined by the following claims.

The invention claimed is:

1. A burner, comprising:

a support wall forming an inlet passage for introducing a mixture of fuel gas and oxidant into the burner, a diffuser wall, which is tubular and coaxial with respect to a longitudinal axis of the burner and having a first end connected to the support wall in flow communication with the inlet passage, a second end closed by a closing wall, and a perforation for the passage of the gas mixture from the interior of the burner to an outer side of the diffuser wall, where the combustion occurs, a first diaphragm with one or more first through openings and a second diaphragm with one or more second through openings, said first and second diaphragms being substantially concentric with the longitudinal axis and arranged in sequence in the inlet passage so that the mixture passes first through the one or more first openings of the first diaphragm and next the one or more second openings of the second diaphragm, wherein each of the first and second diaphragms form a radially inner circular portion and a directly bordering radially outer annular portion, respectively, wherein:

the radially outermost extent of said one or more first openings defines an outer radius (Re) of the outer portions the ratio (Ri/Re) between the radial width (Ri) of the inner portion and the outer radius of the outer portion ranges between 0.6 and 0.7, in the radially outer portions, the sum of the passage area of said one or more first openings is larger than the sum of the passage area of said one or more second openings, in the radially inner portions, the sum of the passage area of said one or more second openings is larger than the sum of the passage area of said one or more first openings, the free axial distance between the first diaphragm and the second diaphragm ranges between 0.22*Re and 0.43*Re, wherein Re is the outer radius (Re) of the outer portions, wherein the first through openings further comprise a central hole concentric with the longitudinal axis and having a passage area that is less than both the total passage area of the first through openings in the radially outer portion of the first diaphragm, and the total passage area of the second through openings in the radially inner portion of the second diaphragm.

2. The burner according to claim 1, wherein the first diaphragm and the second diaphragm are substantially planar and substantially mutually parallel and orthogonal to the longitudinal axis.

3. The burner according to claim 1, wherein the first diaphragm and the second diaphragm have substantially symmetric shapes with respect to the longitudinal axis.

4. The burner according to claim 1, wherein the second through opening of the second diaphragm consists of a single central opening, which is circular and concentric with the longitudinal axis, said central opening having a radial extent, measured from the longitudinal axis, ranging between 0.6*'Re and 0.7*Re, wherein Re is the outer radius (Re) of the outer portion of the first and second diaphragms.

5. The burner according to claim 1, wherein the second through openings of the second diaphragm consist of a central opening concentric with the longitudinal axis and formed in the radially inner portion and a plurality of peripheral holes formed in the radially outer portion and having a total passage area less than the passage area of the central opening.

6. The burner according to claim 1, wherein the first through openings comprise a group of peripheral openings, formed in the radially outer portion of the first diaphragm and having a total passage area larger than the total passage area of the radially inner portion of the first diaphragm.

7. The burner according to claim 6, wherein the group of peripheral openings is arranged in one or more circumferential sequences with respect to the longitudinal axis.

8. The burner according to claim 1, wherein said central hole of the first diaphragm has, as measured from the longitudinal axis, a radial extent of 0.12*Re to 0.22*Re, wherein Re is the outer radius (Re) of the outer portion of the first and second diaphragms.

9. The burner according to claim 1, wherein the first through openings comprise a group of peripheral openings having a "T" shape and arranged in a circumferential sequence with respect to the longitudinal axis, wherein each of the peripheral openings forms a substantially rectilinear portion, oriented in the radial direction with respect to the longitudinal axis, and a tangent portion extending substantially in the circumferential direction with respect to the longitudinal axis.

10. The burner according to claim 9, wherein in said peripheral openings the radial width of the tangent portion is larger than the circumferential width of the rectilinear portion.

11. The burner according to claim 10, wherein said peripheral openings are ten and are arranged at a constant angular pitch, the extent of the tangent portion is 25° to 32°, the radial width of the tangent portion is 0.09*Re to 0.13*Re, and the radial length of the rectilinear portion is 0.6*Re to 0.7*Re, wherein Re is the outer radius (Re) of the outer portion of the first and second diaphragms.

12. The burner according to claim 1, wherein both diaphragms are located completely inside an end length of the diffuser wall on the side of the support wall, wherein said end length has an axial length less than one fourth of the axial length of the diffuser wall.

13. The burner according to claim 1, wherein the first diaphragm comprises deflection edges at least partially defining said first through openings and which are bent outside of the plane of the first diaphragm so as to impart to the flow of mixture a vorticity (swirl) in the circumferential direction to the longitudinal axis.

* * * * *